United States Patent [19]

Schultz

[11] Patent Number: 5,045,445

[45] Date of Patent: Sep. 3, 1991

[54] CONTINUOUS IN-LINE PREPARATION OF PHOTOGRAPHIC GELATIN SOLUTIONS

[75] Inventor: Robert R. Schultz, Rochester, N.Y.

[73] Assignee: E. I. Du Pont de Nemours and Company, Wilmington, Del.

[21] Appl. No.: 545,932

[22] Filed: Jun. 29, 1990

[51] Int. Cl.[5] ..... G03C 1/025; G03C 1/015

[52] U.S. Cl. ..... 430/642; 430/935; 106/125; 106/136; 252/315.1; 252/315.3; 530/354

[58] Field of Search ..... 430/642, 935; 530/354; 106/125, 136; 252/315.1, 315.3

[56] References Cited

U.S. PATENT DOCUMENTS

| | | | |
|---|---|---|---|
| 3,223,528 | 12/1965 | Nicolas et al. | 530/354 |
| 3,681,254 | 8/1972 | Becker | 252/311 |
| 3,707,829 | 1/1973 | Siegel | 55/239 |
| 4,655,840 | 4/1987 | Wittwer et al. | 106/126 |
| 4,673,438 | 6/1987 | Wittwer et al. | 106/126 |

*Primary Examiner*—Charles L. Bowers, Jr.
*Assistant Examiner*—Janis L. Dote

[57] ABSTRACT

A process for the in-line preparation of gelatin solutions comprising (a) mixing gelatin particles with an aqueous solution to wet the gelatin forming a gelatin-aqueous solution mixture, (b) heating rapidly said mixture to a temperature capable of digesting gelatin in said mixture, and (c) maintaining the digested gelatin at said temperature for a period to dissolve the gelatin particles into the aqueous solution.

The process provides gelatin solutions for photographic uses in an improved manner without the general dissolution problems. The process is quick and is accomplished in-line, preferably continuously.

18 Claims, 2 Drawing Sheets

CONTINUOUS IN-LINE PREPARATION OF PHOTOGRAPHIC GELATIN SOLUTIONS

FIELD OF THE INVENTION

This invention relates to the preparation of gelatin solutions. More particularly this invention relates to a continuous process of preparing gelatin solutions for use in photosensitive elements.

BACKGROUND

Photosensitive elements generally consist of a flat substrate, to which at least one, but as a rule several, thin layers have been applied. At least one of these layers is sensitive to light. Other layers, which may or may not be sensitive to light, fulfill diverse auxiliary functions as, for example, protective layers, filter layers, or antihalation layers. Except for special cases, such as vapour-deposited layers, a binder is always required for the production of photographic layers since the binder imparts the necessary cohesion and adhesion function. For conventional photographic elements, which after exposure are processed with aqueous solutions, a hydrophilic binder which is swellable in water is preferred. Gelatin is particularly suitable as such a binder and is generally the principal binder for photosensitive elements. Additionally, gelatin is used in the food and the pharmaceuticals industries for example to form capsules containing medical preparations, and to prepare jellies. For ease in transport and handling, gelatin generally is sold to the photographic, food and pharmaceutical industries in the form of a relatively dry solid, i.e., pellet, flake, particle, granule, etc. containing not more than 10 to 15 percent moisture. The dry gelatin particles are dissolved into a liquid, generally water, to prepare a gelatin solution suitable for use.

Conventional methods used to dissolve gelatin have consisted of methods in which a fixed amount of dry solid particles of gelatin is immersed in a fixed amount of aqueous solution, e.g., water at about 60° to 80° F. (15.5° to 26.7° C.), and generally soaked for a period of time to thoroughly wet and swell the dry particles with the water. Thereafter, the mixture of particles and water mixture is agitated and heated to a temperature and for a time sufficient to dissolve the gelatin particles into solution. There are several problems associated with this cold soaking mixing method for dissolving gelatin. One of the problems is that the solid gelatin particles are not easily wetted and tend to float on the liquid surface. The non-wetting is even more troublesome if the gelatin is added to hot water, i.e., 85° F. (29.4° C.) or higher, or to previously prepared gelatinous solutions. In such cases, the particles become sticky and agglomerate before they can be adequately dispersed, and form large lumps that dissolve very slowly. If, in an effort to improve dissolution, the agitation of the solution is increased, excessive quantities of air are entrained in the solution causing undesirable bubbles and foam. This foam collects at the top surface of the solution stiffening as it dries, and frequently, portions of the stiffened foam fall back into the gelatin solution which do not readily dissolve. Filtration does not always adequately separate these agglomerates and undissolved foam portions from the solution, especially at elevated pressures which can result in 'extrusion' of undissolved gelatin through the filter. In the case of photographic materials, these agglomerates and undissolved foam portions adversely affect the coated quality of a gelatin-containing layer.

Furthermore, this method is a time consuming batch process in which a minimum of about 40 to 60 minutes is needed to completely dissolve gelatin particles in the water. Generally, gelatin particles are soaked 10 to 60 minutes, digested or dissolved for at least 15 minutes at an elevated temperature, and there is considerable time required for the mixture in the vessel to reach the elevated temperature as it is dependent upon heat transfer rates, volume of the vessel, and other factors knowledgeable to one skilled in the art. Also, if there are any delays in the consumption of the gelatin solution due to upsets in subsequent process steps, the gelatin solution can readily degrade as the elevated temperature causes the water to evaporate from the solution and other problems can occur, such as bacterial growth, depending upon the additives to the gelatin solution.

It is an object of this invention to provide a method for preparing gelatin solutions in which the gelatin particles are dissolved in an aqueous solution and do not have the dissolution problems associated with prior methods.

It is another object of this invention to provide a method of preparing gelatin solutions in-line which is continuous and is accomplished in a short time period so that subsequent process steps in the formation of photographic elements can receive dissolved gelatin solution on demand, for immediate consumption. These and other objects of the present invention will be clear from the following description.

SUMMARY OF THE INVENTION

In accordance with this invention there is provided a process for the in-line preparation of gelatin solutions comprising (a) mixing gelatin particles with an aqueous solution to wet the gelatin to form a gelatin-aqueous solution mixture, (b) heating rapidly the gelatin-aqueous solution mixture to a temperature capable of digesting the gelatin in the mixture, and (c) maintaining the digesting gelatin for a period sufficient to dissolve the gelatin particles into the aqueous solution.

BRIEF DESCRIPTION OF THE DRAWINGS

The accompanying FIGURES form a material part of this disclosure wherein.

DETAILED DESCRIPTION OF THE INVENTION

Batch preparation of gelatin solutions is time consuming, labor intensive and results in unnecessary restrictions in the manufacturing operation process. Typically, gelatin solutions are batch prepared frequently since gelatin is the primary binder used in various layers of a photographic element. I have discovered a process to prepare a gelatin solution in-line which is quick and relatively easy providing greater operation flexibility and reduces or eliminates many of the dissolution problems associated with batch preparation processes.

Advantageously, the process of this invention has higher and more consistent heat transfer to, and dissolution of, the gelatin without the high level of foaming and aeration which occurs in normal batch processes. The process of this invention is useful for preparing gelatin solutions with concentrations in the range of 0.1 to 50 percent by weight, preferably 3 to 15 percent by weight, of gelatin in the solution.

Figure 1:
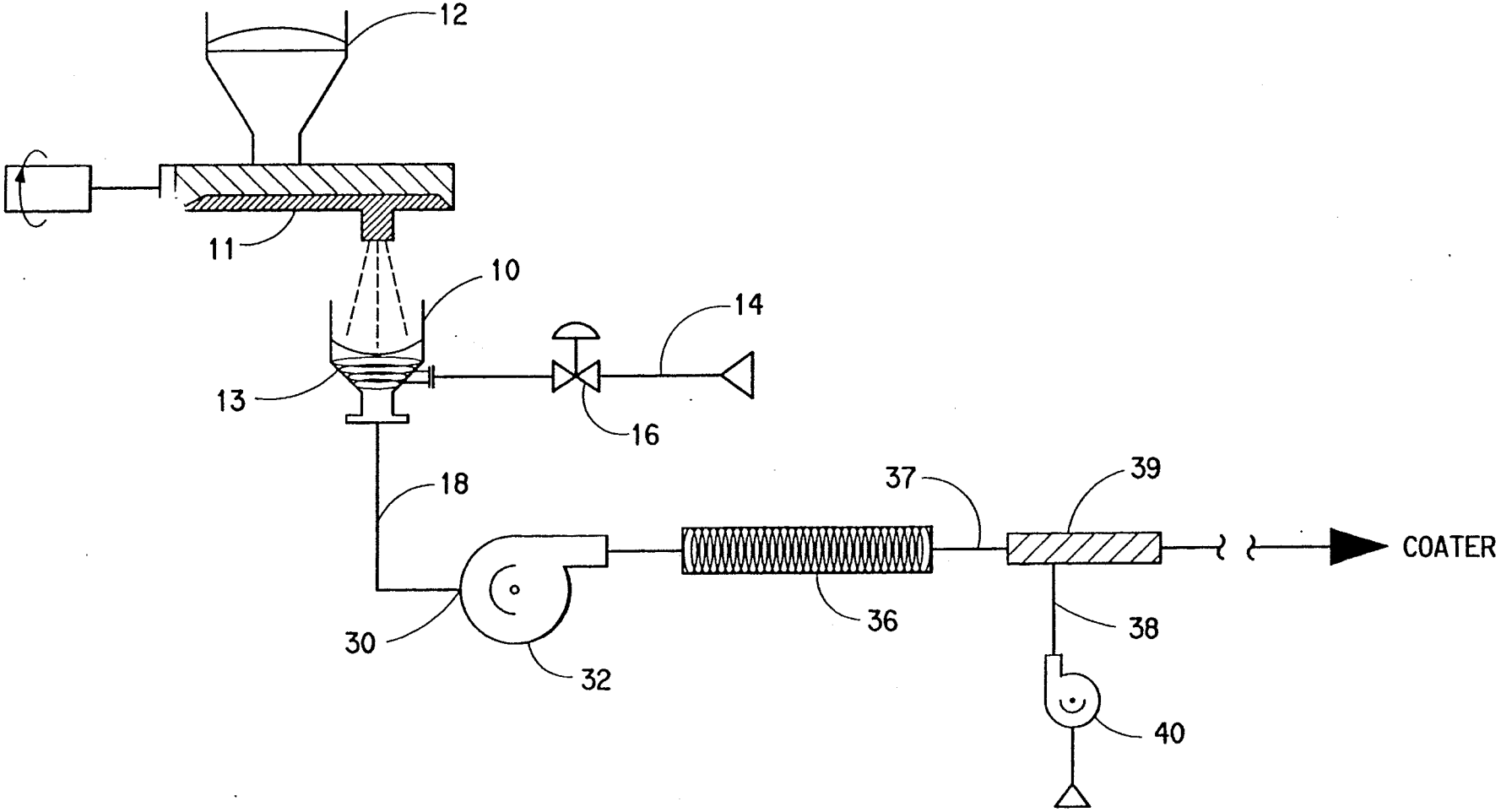
FIG. 1 is a schematic of the process wherein the rapid heating and dissolution of the gelatin particles and aqueous solution mixture occurs in one heating apparatus.

The process of this invention can be understood by referring now specifically to the drawings wherein like numbers in the drawings refer to the same elements. FIG. 1 illustrates an apparatus for practicing an embodiment of this invention in which solid gelatin particles and an aqueous solution are mixed in a vessel 10 to form a gelatin-aqueous solution mixture. A solids feeder 11 is provided to accurately dispense the gelatin particles from a container 12 into vessel 10. An agitator 13 is provided in vessel 10. A conduit or stream 14 with a control device 16 such as a valve or metering pump is provided for the addition of the aqueous solution to vessel 10. The range of temperature of the aqueous solution is from 35 to 200° F. (1.7° to 93.3° C.), preferably a temperature range of about 60° F. to 80° F. (15.5 to 26.7° C.). Various additives or adjuvants, for example, surfactant(s) or wetting agent(s) to enhance wetting of the gelatin particles, pH modifiers etc. may be mixed (not shown) with the aqueous solution prior to mixing the aqueous solution with the gelatin particles or the adjuvant(s) may be added directly to vessel 10. Means for mixing and/or adding the adjuvants is conventional to one skilled in the art. The gelatin particles and the aqueous solution are mixed in an appropriate proportion which produces the final concentration of the gelatin-aqueous solution desired. The proportion of the gelatin particles and the aqueous solution may be adjusted if any adjuvants or additives are added during or subsequent to the mixing step. The residence time of the gelatin-aqueous solution mixture in vessel 10 is less than the conventional cold gel soak step of batch gelatin dissolution process as described previously, e.g., less than about 10 minutes. The volume of vessel 10 can be minimized if the gelatin particles and the aqueous solution are continuously mixed in the appropriate proportions and taking into account the residence time required, if any, to ensure wetting of the gelatin particles, while the gelatin-aqueous solution mixture continuously exits vessel 10. Mixing is to ensure the wetting of the gelatin particles by the aqueous solution. It is not necessary to allow time for the swelling of gelatin particles in the mixing step, in order for dissolution or digestion to occur. It is preferred to mix the gelatin particles and the aqueous solution in a vessel with agitation means. However, other techniques for mixing which are well known to those skilled in the art are suitable. For example, the gelatin particles and the aqueous solution can be mixed in-line with various types of mixing apparatuses such as static or dynamic mixers. The gelatin-aqueous solution mixture exits vessel 10 through a conduit or stream 18 which is connected to the supply side (suction) 30 of a first metering pump 32.

Figure 2:
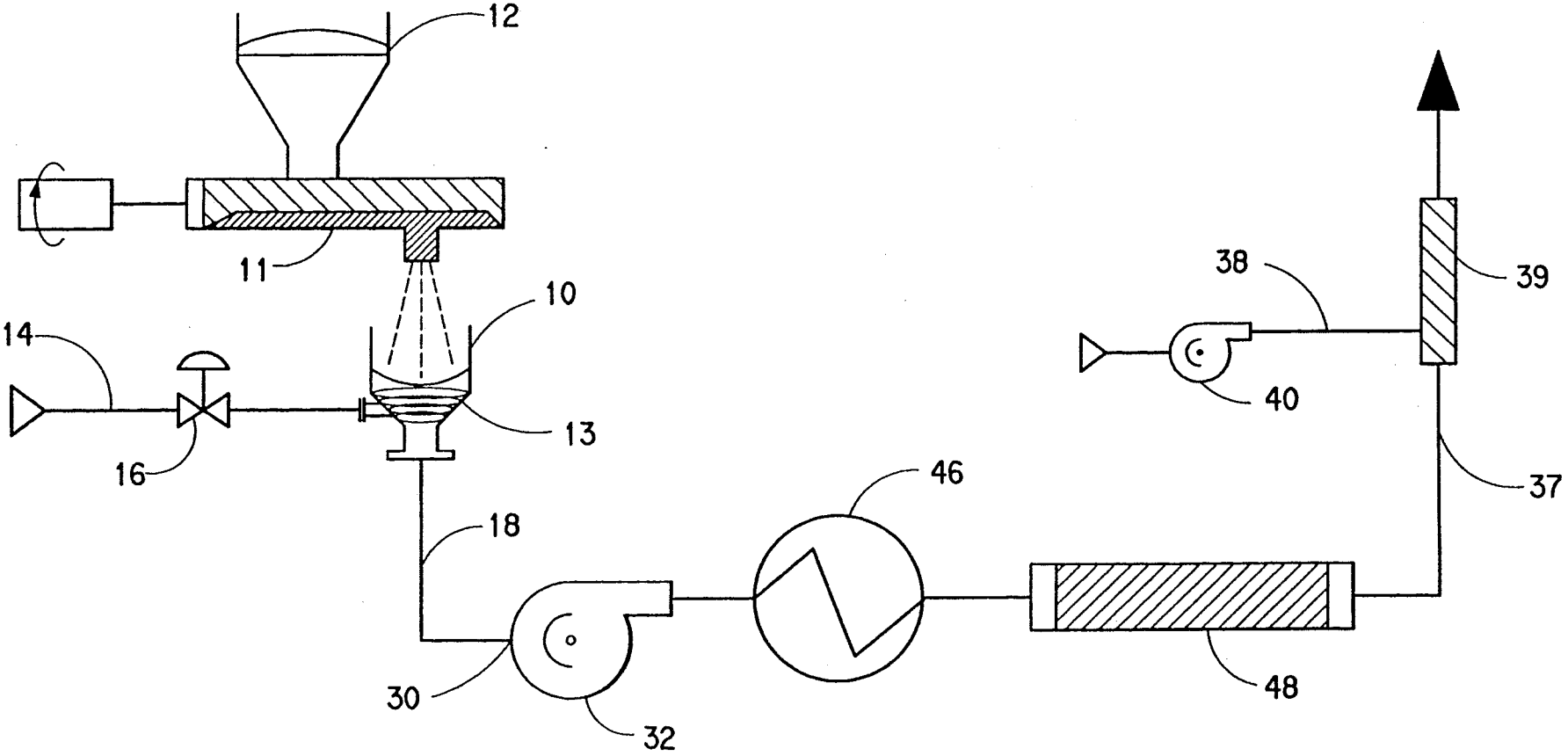
FIG. 2 is a schematic of an alternate embodiment of the process wherein the rapid heating and dissolution of the gelatin particles and aqueous solution mixture occur in separate heating apparatuses.

The gelatin-aqueous solution mixture passed from vessel 10 through conduit or stream 18 is heated in at least one heating apparatus 36 (FIG. 1), or 46, and 48 (FIG. 2). Metering pump 32 is provided for controlling the flow rate of the mixture through heating apparatus 36 or apparatuses 46, 48. In the embodiment of FIG. 1, the temperature of the mixture is raised and maintained by heating apparatus 36 at an elevated temperature capable of dissolving the gelatin particles into the aqueous solution and form a gelatin solution exiting the heating apparatus 36, e.g., heat exchanger, in a conduit or stream 37. FIG. 2 illustrates another embodiment of this invention wherein the gelatin-aqueous solution mixture is separately heated to the elevated temperature in a first heating apparatus 46 and then maintained and/or heated additionally to the elevated temperature in a second heating apparatus 48 to form a gelatin solution exiting the second heating apparatus 48 in conduit or stream 37.

The rapid heating of the gelatin-aqueous solution mixture is accomplished by conventional in-line heating means such as heat exchangers, for example, countercurrent or concurrent shell and tube, or heated pipes or tubes in which heat is provided electrically or by other means, etc. The rapid heating step can occur in one or more heating apparatuses. It is desirable to raise the temperature of the mixture to a temperature capable of dissolving or digesting the gelatin particles into the aqueous solution as quickly as possible in order to minimize the residence time of the mixture in the system and gain the advantages of this invention. Thus the gelatin-aqueous solution mixture is rapidly heated to a temperature of approximately between 120° to 200° F. (48.9° to 93.3° C.), preferably 150° to 170° F. (65.6° to 76.7° C.). The residence time of the mixture in the system and, in particular, in the rapid heating step of this invention is minimized by ensuring a high rate of heat transfer to the mixture. Optimally, the heat transfer to the mixture is maximized within various limitations of the system such as the residence time desired, the temperature of the mixture entering the heating apparatus, the temperature to digest or dissolve the mixture, etc. The rate of heat transfer is related to many factors, including but not limited to, the physical properties of the mixture, such as heat capacity, density, viscosity, etc., flow rate of the mixture and heating medium if any, materials of construction, surface roughness of the heating tubes, geometry of the heating apparatus, etc. Heating apparatus design is conventional and a suitable discussion on the subject is in *Chemical Engineers' Handbook*, Perry R. H. and C. Chilton, Sections 10 and 11 'Heat Transmission' and 'Heat Transfer Equipment', respectively, 5th edition. Preferably steps (b) and (c) occur in less than about 25 minutes, more preferably in less than about 10 minutes.

As the gelatin-aqueous solution mixture is heated to the elevated temperature, the gelatin particles begin to digest or dissolve into the solution. However, rapidly heating the mixture generally does not provide enough time for complete dissolution of the gelatin particles into the aqueous solution. So the digesting gelatin is maintained at the digesting temperature for a period sufficient to dissolve the gelatin particles and form a gelatin solution. Maintaining the digesting gelatin at the elevated temperature is accomplished similarly to the rapid heating step wherein conventional in-line heating means such as heat exchangers or heated pipes or tubes are suitable. The digesting gelatin can be maintained at the digesting temperature in the same heating apparatus where the rapid heating step occurred or in one or more separate heating apparatuses or in devices designed to reduce heat lose and maintain the necessary temperature required for digestion.

Turbulent flow is desirable in this process and provides increased heat transfer rates, dissolution, and hence higher digestion rates of the gelatin into solution. Dry gelatin can be digested to solution using this process regardless of dry particle size, by providing adequate time at an elevated temperature within the process to accomplish the digestion. Techniques for providing adequate time are known to one skilled in the art and can include, for example, lengthening the travel path of the mixture through the system and having relatively slower flow rates once at the elevated temperature of the mixture through the system. The required time for this dissolution increases in proportion to the increase in the average size of the dry gelatin particles to be digested to solution. The gelatin solution exiting the heating apparatus in stream 37 produced by the process of this invention is useful as an ingredient in formulations useful in photographic materials, for example antihalation, protection and emulsion layers. Further, the gelatin solution produced by the process of this invention may undergo one or more additional process steps, for example, filtration, cooling, debubbling, before incorporation as an ingredient into formulations, i.e., photosensitive for photographic elements.

Deairation of the gelatin solution may be necessary since the heating of aqueous systems normally results in the evolution of air, particularly if the flow of the solution through the in-line dissolution system is turbulent. In this situation, the gelatin solution can be vented to the atmosphere at some point after the gelatin particles have dissolved into the aqueous solution. The gelatin solution can be vented for example in a vessel open to the atmosphere. Venting the solution while the gelatin solution is substantially at the digesting temperature facilitates the removal of the entrapped air.

Optionally, the exiting gelatin solution stream 37 can have additives or adjuvants added in-line as shown in the FIGS. 1 and 2. Additives in conduit or stream 38 can be added in-line by conventional means or preferably with a mixer 39 and a second metering pump 40. At least one mixer and pump system can be used for the in-line addition of the additive(s) to the gelatin solution stream 37. The mixer 39 is preferably a tee-mixer, although other types of static and dynamic mixers may be used. Solutions which can be added in-line can be any additives normally used in photographic compositions such as stabilizers, antifoggants, covering power improving agents, film property improving agents, surfactants, hardeners, matting agents, developing agents, dyes, antistatic agents, etc. The gelatin solution modified in-line could travel directly to the coating station or undergo pretreatment such as debubbling, cooling for application, e.g., coating to a substrate, e.g., films, paper, web, etc., as a layer of a photographic element.

Another embodiment of this invention is one in which the gelatin particles are mixed with the aqueous solution and allowed to soak for a period of time to cause the gelatin particles to swell, i.e., cold gel soak step, or to partially swell and then the mixture undergoes the rapid heating and maintaining steps (b) and (c), respectively, of this invention as discussed previously.

There are no particular restrictions on the type of gelatin used in the present invention. Various types of gelatin used in the manufacture of silver halide photographic emulsions and gelatin related components, are suitable, for example, lime-treated gelatin, acid-treated gelatin, phthalated, and derivative gelatins, etc. Conventional forms of the solid gelatin which are suitable for use in this invention include but are not limited to: pellet, flake, particle, granule, etc. forms and as such are considered equivalents for the purpose of this disclosure. The solid gelatin suitable for use in this invention is relatively dry in that it contains not more than 10 to 15 percent moisture. Typically the moisture content for 8 mesh gelatin is 9.5% to 11% moisture and 9.0 to 10.5% moisture for 40 mesh gelatin. The range of gelatin particle size suitable for use in this invention is generally between about 400 micrometers to about 2400 micrometers (40 to 8 mesh, respectively), preferably less than 1200 micrometers. The most preferred range of gelatin particle size is the smallest possible, in order to reduce the time required for gelatin dissolution. Generally gelatin can be purchased in desired particle size. Alternatively large particle size gelatin can be reduced with a size reduction apparatus for wet comminution, such as the Comitrol Comminuting unit sold by Urschel Laboratories, Inc., Valaparaiso, IN, which wets and size reduces the particles. The gelatin particle size can be smaller than 400 micrometers; however, the safety aspects of handling such fine size particles or powder is a practical concern and would make the process of this invention generally more cumbersome.

The following examples are used to demonstrate this invention without limitation. In the examples the percentages are by weight.

EXAMPLE 1

This example demonstrates the method of this invention using 420 micrometer size solid gelatin particles with deionized water to prepare a 9.1 percent by weight dissolved gelatin solution.

(a) The solid gelatin used in this example was Kind and Knox (hereinafter referred to as K&K) surface type #2964 photograde, which had been ground to 40 mesh particle size (420 micrometers). Eighty-five (85) grams of the gelatin particles were added to 850 ml deionized water, in a vessel. The water temperature was 68° F. (20° C.). Manual agitation was used to wet out the gelatin particles.

(b) The gelatin-water mixture was immediately added to a 600 ml glass laboratory funnel which was used as a feed reservoir to supply the mixture to the process. Throughout the experiment, the gelatin-water mixture was continuously replenished to the supply funnel as required to maintain an uninterrupted flow to the system pump. (Approximately 1000 gm of the mixture was made and added to the supply funnel as needed.) The supply funnel was connected via laboratory Tygon tubing to a peristaltic pump used to move the gelatin-water mixture through heated tubular coils.

(c) The gelatin-water mixture was rapidly heated in tubular coils at a flow rate through the tubular coils of 1 liter per minute. The tubular coils consisted of a 50 foot (15.2 meter) length of copper tubing with $\frac{3}{8}$ inch (0.95 cm) outside diameter (0.307 inch (0.78 cm) inside diameter) coiled and immersed in a water bath held at 127° F. (52.7° C.), in series with a second 50 foot (15.2 meter) coiled copper tube of $\frac{1}{4}$ inch (0.64 cm) outside diameter (0.190 inch (0.48 cm) inside diameter) immersed in a second water bath held at 150° F. (65.5° C.). The residence time from the supply tube (at the exit of the supply funnel) to the exit of the first heated coil was 60 seconds. The residence time from the exit of the first coil to the exit of the second heated coil, where digestion was complete, was 38 seconds.

In this example, 1.0 Liter per minute of 9.1% gelatin solution was produced, dry gelatin to digested gelatin solution, in 2 minutes 34 seconds. Quality of the gel solution was satisfactory as judged visually by good solution clarity and the absence of undigested gelatin particles in the process exit stream.

The procedure of this example was repeated except that the experiment using gelatin particles of 8 mesh (2,380 micrometers) particle size, sold by K&K type #2964, were mixed with deionized water and sent through the tubular coils at the same flow rate as in Example 1. The gelatin particles did not digest as judged visually by the presence of a high number of undigested gel particles at the exit of the process. In order to digest larger size gelatin particles, e.g., 8 mesh, longer residence times are required, e.g., obtained by using longer tube lengths or slowing down flow rate.

EXAMPLE 2

The method of this example is the same as described in Example 1 except that it illustrates the method of this invention using larger size gelatin particles. The gelatin particles used were 28 mesh (640 micrometers) particle size, sold by K&K type #2964 gelatin. Eighty-five (85) gm of the gelatin particles were added to 850 ml deionized water in a vessel. The water temperature was 68° F (20° C.). The gelatin-water mixture was immediately added to the supply funnel as described in Example 1. Flow rate through the tubular coils was 0.45 liter per minute. The tubular coils consisted of two 50 foot (15.2 meter) lengths of copper tubing with ⅜ inch (0.95 cm) outside diameter (0.307 inch (0.78 cm) inside diameter) coiled and each separately immersed into a water bath at 130° F. (54.4° C.) and 165° F. (73.9° C.), respectively. Total process time was 4 minutes 50 seconds from dry gelatin to digested gelatin solution. The residence time in the system from the supply funnel exit through both tubular coils was 3 minutes 17 seconds. The 9.1% gel solution produced was visually checked to be completely digested and clear.

EXAMPLE 3

This example illustrates another embodiment of the method of this invention in which the gelatin particles are presoaked in water for a period of time before the mixture undergoes rapid heating and dissolution steps (a) Eighty-five (85) gm of gelatin particles 8 mesh (2,380 micrometers) in size was added to 850 gm of 70° F. (21.2° C.) deionized water in a vessel. The gelatin was soaked for 30 minutes, forming a slurry.

(b) The equipment was configured as described in Example 2, with each coil heated by water baths at 125° F. (51.7° C.) and 165° F. (73.9° C.), respectively. The resultant gelatin-water slurry was pumped through the heated coils at 1.0 liter per minute. The residence time from the supply tube from the exit of the funnel to the exit of the second heated coil was 2 minutes. The 9.1% by weight gelatin solution produced was clear and fully digested.

EXAMPLE 4

This example illustrates another embodiment of this invention in which the gelatin solution was deairated and prepared and coated as a backing layer on a photosensitive material.

(a) The gelatin used in this example was 40 mesh (420 micrometers) particle size, sold by K&K type #2964. The gelatin particles were metered into a 3 liter premix vessel at 197 grams per minute by a precision gravimetric loss-in-weight solids feeder, Model HO-DSR/28/10, manufactured by Control and Metering Limited, Toronto, Canada. The premix vessel was fitted with a standard laboratory agitator, vertically mounted, to provide mechanical means for wetting the dry gelatin with deionized water. At the same time as the gelatin add, the water was metered into the premix vessel at 2,240 milliliters per minute using a peristaltic metering pump, such as manufactured by Masterflex. The proportion of gelatin to water was 8.08% by weight. The gelatin-water mixture was drawn at a flow rate of 2.43 liters/minute from the bottom of the premix vessel directly into the supply port of a progressive cavity pump, such as manufactured by Netzsch.

b) The gelatin-water mixture was rapidly heated and the gelatin particles were dissolved into the water in a 3 part heating and digesting apparatus which comprised of 2 electrically heated tubes with a countercurrent (tube-within-a-tube design) heat exchanger therebetween. The mixture was pumped through the apparatus at a flow rate of 2.43 liters per minute directly to a first electrically heated, insulated coiled tube of stainless steel, 7/16 inch (1.1 cm) inside diameter, and 50 foot (15.2 meter) (uncoiled length), then into the countercurrent heat exchanger, followed by a second electrically heated coiled tube as described above. The two electrically heated coiled tubes were Model 500 manufactured by Technical Heaters, Inc. of San Fernando, Calif. and were fitted with a Model 8000 temperature controller also sold by Technical Heaters, Inc. Residence times for the mixture were 36 seconds for each electrically heated coiled tube, and 10 seconds for the countercurrent heat exchanger. Total heated system residence time, i.e., the time in which the mixture was held at the elevated temperature, was 3 minutes and 51 seconds. The exit temperature of the gelatin-water mixture of the first coiled tube was 126° F. (52.2° C.), and 165° F. (73.9° C.) for the second.

c) At the exit of the second electrically heated tube, the digested solution entered an air venting chamber where the solution was deairated by allowing air entrapped in the solution to escape and vent to the atmosphere. The average heated residence time in the venting chamber was 2 minutes and 29 seconds. The line pressure dropped 22.8 PSIA (1.6 kgs/sq cm) from the pump to the vent chamber, and 13.8 PSIA (0.97 kgs/sq cm) from the vent chamber to the exit of the process wherein the gel is fully digested to a gel solution.

d) A solution suitable as a backing layer for photographic film was prepared by the addition of suitable ingredients, such as wetting agents, crosslinking agents, dyes, and pH modifiers, to the digested and deairated gelatin solution. The added ingredients were in-line injected into a process line carrying the dissolved gelatin solution. All dyes were mixed prior to in-line injecting into the gelatin solution. Each of the other solutions were separately injected into the gelatin solution, in series. The prepared backing solution was 7.5% gelatin concentration by weight, with viscosity of 25.4 centipoises, surface tension of 37 dynes per cm, and pH of 5.31. This solution was debubbled, tempered, and filtered using conventional means, and immediately applied to 0.004 inch (0.010 cm) thick polyester film base at a dry gel weight of 3.5 grams per square meter using conventional coating and air impingement drying processes known in the art. Macbeth transmission densities and physical properties of the gelatin backing exhibited normal appearance and processing characteristics.

EXAMPLE 5

This example illustrates another embodiment of this invention in which the gelatin solution was deairated and prepared and coated as a protective overcoat layer on a conventional photosensitive silver halide emulsion layer.

In a process similar to that described in Example 4, steps (a) through (c), a gelatin overcoat solution was prepared according to the invention. 52.5 grams per minute gelatin and 1,065 grams per minute deionized water were mixed to prepare a 4.7% by weight gelatin-aqueous solution mixture at a flow rate of 1.12 liters per minute. Residence time in each electrically heated coil was 1 minute 19 seconds, and 23 seconds for the countercurrent heat exchanger. Total heated system residence time was 3 minutes 54 seconds. Exit process stream temperatures from the 2 electrically heated tubular coils were 127° F. (52.8° C.) and 160° F. (71.1° C.), respectively.

Subsequent to gelatin dissolution and venting, ingredients suitable for protective layer additives were in-line injected, including wetting agents, crosslinking agents, surface agents and including "matting" agents. Final overcoat solution properties were: pH, 5.7; surface tension, 34 dynes per centimeter; viscosity, 10 centipoises. The 4.3% by weight gelatin overcoat solution prepared by this means was delivered directly to the multilayer film coating operation over the photographic silver halide emulsion layer without further treatment. The resultant wet film coating was subsequently dried using conventional means in a high rate air impingement film dryer. The resultant photosensitive film exhibited normal physical and sensitometric properties.

EXAMPLE 6

This example illustrates the process of this invention to produce a protective layer similar to that described in Example 5, including pretreatment of the protective layer before coating as described in Example 5, steps (a) through (c), using a gelatin-aqueous solution mixture of 7.5% by weight gelatin which was prepared by mixing gelatin particles and deionized water into premix vessel. The mixture flow rate from the vessel was 2.25 liters per minute. System residence times were 39 seconds for each electrically heated tubular coil, and 11 seconds for the countercurrent heat exchanger. Total heated system residence time for complete digestion was 4 minutes 9 seconds after wetting the dry gelatin. System temperatures were 129° F. (53.9° C.) after the first electrically heated coil, and 164° F. (73.3° C.) after the second coil, with system pressure drops of 13.3 PSIA (0.94 kgs/sq cm) to the system vent, and 11.3 PSIA (0.79 kgs/sq cm) from the vent to the exit of the process. After in-line injection of additives into the fully digested gelatin solution, the flow rate of the resulting 6.6% gelatin overcoat solution was 2.55 liters/min. Solution properties were: pH, 5.6; surface tension, 37 dynes per cm; and viscosity, 27 centipoises. The completed gelatin overcoat solution was supplied to a conventional coater delivery system normally used in the art, for debubbling, temperature adjustment, and filtration prior to consumption in a multilayer coating process, and drying in an air impingement type dryer known in the art. The resultant photosensitive film product exhibited normal physical and sensitometric properties.

I claim:

1. A process for the in-line preparation of gelatin solutions comprising (a) mixing gelatin particles with an aqueous solution to wet the gelatin to form a gelatin-aqueous solution mixture containing 0.1 to 50 percent by weight gelatin.

(b) heating rapidly the gelatin-aqueous solution mixture to a heating means and heating the gelatin-aqueous solution mixture to a temperature capable of digesting the gelatin in the mixture. and (c) maintaining the digesting gelatin for a period sufficient to dissolve the gelatin particles into the aqueous solution, wherein heating step (b) and maintaining step (c) occur in less than about 25 minutes.

2. A process according to claim 1 wherein subsequent to step (c) venting the gelatin solution to the atmosphere in a vessel whereby deairation of the solution occurs.

3. A process according to claim 1 wherein into the digested gelatin solution is injected in-line at least one additive for the preparation of a photosensitive solution layer.

4. A process according to claim 2 wherein into the digested gelatin solution is injected in-line at least one additive for the preparation of a photosensitive solution layer.

5. A process according to claim 1 wherein the heating and maintaining of the mixture occurs in one heating means.

6. A process according to claim 1 wherein the heating of the mixture occurs in at least one heating means.

7. A process according to claim 6 wherein the gelatin-aqueous solution mixture is passed into the heating means.

8. A process according to claim 1 wherein the maintaining of the mixture occurs in at least one heating means.

9. A process according to claim 1 wherein the gelatin particle size is equal to or less than 2400 micrometers.

10. A process according to claim 1 wherein in step (a) soaking the gelatin particles in the aqueous solution for a time sufficient to swell the gelatin particles, before rapidly heating the mixture.

11. A process according to claim 1 wherein the aqueous solution is water.

12. A process according to claim 1 wherein the aqueous solution contains at least one additive for the preparation of the gelatin solution.

13. A process according to claim 1 wherein the rapid heating step (b) and maintaining step (c) occur in less than about 10 minutes.

14. A process according to claim 1 wherein the in-line preparation of gelatin solutions is continuous.

15. A process according to claim 7 wherein the gelatin-aqueous solution mixture passes into the heating means with turbulent flow.

16. A process according to claim 1 wherein the dissolved gelatin solution in step (c) is coated as a layer on a substrate.

17. A process according to claim 1 wherein the dissolved gelatin solution in step (c) is incorporated with a photosensitive composition.

18. A process according to claim 1 wherein the gelatin-aqueous solution mixture contains 3 to 15 percent by weight gelatin.

* * * * *

UNITED STATES PATENT AND TRADEMARK OFFICE

CERTIFICATE OF CORRECTION

PATENT NO. : 5,045,445

DATED : September 3, 1991

INVENTOR(S) : Robert R. Schultz

It is certified that error appears in the above—identified patent and that said Letters Patent is hereby corrected as shown below:

Column 10, lines 10-17 should read:

(b) passing in-line the gelatin-aqueous solution mixture to a heating means and heating the gelatin-aqueous solution mixture to a temperature capable of digesting the gelatin in the mixture, and (c) maintaining in-line the digesting gelatin for a period sufficient to dissolve the gelatin particles into the aqueous solution, wherein heating step (b) and maintaining step (c) occur in less than about 25 minutes.

Signed and Sealed this

First Day of June, 1993

*Attest:*

Michael K. Kirk

MICHAEL K. KIRK

*Attesting Officer*

*Acting Commissioner of Patents and Trademarks*